US009114289B1

(12) United States Patent
Bradshaw

(10) Patent No.: US 9,114,289 B1
(45) **Date of Patent: *Aug. 25, 2015**

(54) GOLF BALL MARK REPAIR TOOL

(75) Inventor: Bruce Bradshaw, Clarion, IA (US)

(73) Assignee: Team Effort, Inc., Clarion, IA (US)

( * ) Notice: Subject to any disclaimer, the term of this patent is extended or adjusted under 35 U.S.C. 154(b) by 615 days.

This patent is subject to a terminal disclaimer.

(21) Appl. No.: 11/534,721

(22) Filed: Sep. 25, 2006

Related U.S. Application Data

(63) Continuation of application No. 11/039,477, filed on Jan. 19, 2005, now Pat. No. 7,611,426.

(51) Int. Cl.
*A63B 57/00* (2006.01)

(52) U.S. Cl.
CPC ..... *A63B 57/0068* (2013.01)

(58) Field of Classification Search
CPC ..... A63B 57/0068
USPC ..... 473/406, 408; D21/793
See application file for complete search history.

(56) References Cited

U.S. PATENT DOCUMENTS

| | | | | |
|---|---|---|---|---|
| 3,618,673 | A * | 11/1971 | Gossett | 473/408 |
| D300,760 | S | 4/1989 | Krokus, Sr. | |
| 4,960,239 | A * | 10/1990 | Wait | 473/406 |
| 5,054,777 | A * | 10/1991 | Borden et al. | 473/408 |
| 5,121,519 | A | 6/1992 | Haugom | |
| 5,269,513 | A * | 12/1993 | Gervais | 473/408 |
| D360,450 | S | 7/1995 | Louden et al. | |
| D383,516 | S | 9/1997 | Stevens | |
| 5,686,158 | A | 11/1997 | Gibbon | |
| 6,033,322 | A | 3/2000 | England | |
| D422,664 | S | 4/2000 | Tate | |
| D424,151 | S | 5/2000 | Miura | |
| D434,825 | S | 12/2000 | Miura | |
| D436,152 | S | 1/2001 | Sanford, III | |
| 6,217,465 | B1 | 4/2001 | Kenia, Jr. | |
| 6,224,502 | B1 * | 5/2001 | Warfield | 473/408 |
| 6,270,424 | B1 * | 8/2001 | Holub | 473/408 |
| 6,502,646 | B2 | 1/2003 | Wiens | |
| D470,556 | S | 2/2003 | Guerette et al. | |
| 6,565,458 | B1 | 5/2003 | Cameron | |
| D508,104 | S | 8/2005 | Haug | |
| 7,238,126 | B1 * | 7/2007 | Wiens et al. | 473/408 |
| 2001/0029213 | A1 | 10/2001 | Hendren | |
| 2004/0023733 | A1 | 2/2004 | Tummillo | |

OTHER PUBLICATIONS

"Leave Your mark on the game—fixing a ball mark on a putting green—Brief Article" Golf Digest, Oct. 1999, 2 pages.
Achenbach, James "Latest News Golfweek", The Problem—The Tools—The Solution—Testimonials, 2004 Green Fix Golf, 13 pages.
"GreenFix Repair Tool Putter Grips" TGW.com, The Golf Warehouse, 2 pages, retrieved Jan. 2, 2005.

(Continued)

*Primary Examiner* — Steven Wong
(74) *Attorney, Agent, or Firm* — Ryan N. Carter

(57) ABSTRACT

A golf ball mark repair tool having the advantage of promoting the proper technique for repairing a ball mark on a green is provided. The ball mark repair tool generally includes a body member and a plurality of prongs extending from the body member. The prongs have an arcuate shape and project forwardly from the body member to facilitate pushing the edge of the ball mark towards the center. A method of using the ball mark repair tool is also provided.

8 Claims, 2 Drawing Sheets

(56) References Cited

OTHER PUBLICATIONS

"How to Reapir a Ball Mark" Green-Save.com, 1 page, Jan. 2, 2005.
Fry, Jack, et al. "Evaluation of Ball Mark Reapir Methods and Creeping Bentgrass Recovery" Greenfix Golf, Inc. pp. 41-46, submitted Jan. 19, 2005.
"The New, Easy Way to Repair Ball Marks" GreenFix Putter Grips, Swing Science, 2 pages, retrieved Jan. 2, 2005.
Kirkman, Brad "Ask Brad" Triad Golf Today, Triadgolf.com, 2 pages, retrieved Jan. 2, 2005.
"Bethlehem Olive Classic Cigar Holder/Divot Tool #10", Doug Tanaka Divot Tools product sheet from http://www.dougtanakadivottools.com/servlet/the-77/Bethlehem-Olive-wood-cigar/Detail. 1 sheet, retrieved Feb. 2, 2010.
"Snakewood Original Cigar Holder/Divot Tool", Doug Tanaka Divot Tools product sheet from http://www.dougtanakadivottools.com/servlet/the-45/Unique-Snakewood-Cigar-Holder/Detail. 1 sheet, retrieved Feb. 2, 2010.
"Pitchpro The Key to Better Greens!", product sheet from http://www.pitchprogolf.com. 1 sheet, retrieved Feb. 2, 2010.
"Softspikes Push Tool", Softspikes product sheet from http://www.softspikes.com/Default.aspx?tabid=491. 1 sheet, retrieved Feb. 2, 2010.
"About Doug Tanaka Divot Tools", Doug Tanaka Divot Tools article from http://www.dougtanakadivottools.com/servlet/the-template/about/Page. 2 pages, retrieved Feb. 2, 2010.
"Push-Style Divot Tools", Doug Tanaka Divot Tools product sheets from http://www.dougtanakadivottools.com/servlet/Categories. 3 pages, retrieved Feb. 2, 2010.
"Please Be a Steward of Golf", Doug Tanaka Divot Tools article from http://www.dougtanakadivottools.com/servlet/StoreFront. 4 pages, retrieved Feb. 2, 2010.

* cited by examiner

GOLF BALL MARK REPAIR TOOL

CROSS-REFERENCE TO RELATED APPLICATIONS

This application is a Continuation of Ser. No. 11/039,477 filed Jan. 19, 2005, herein incorporated by reference.

BACKGROUND OF THE INVENTION

1. Field of the Invention

This invention relates generally to golf accessories or tools. More particularly, though not exclusively, the present invention relates to a tool for repairing ball marks on golf greens.

2. Problems in the Art

Golf course superintendents and ground crews spend considerable time and resources maintaining golf greens. Their goal is to provide a healthy, smooth and consistent surface for putting a golf ball. Ball marks are particularly problematic. A ball mark is a depression in the putting green having a sunken center and generally circular walls. Ball marks are created when golf balls hit the green from an approach shot, often a highly lofted shot. Golf etiquette provides that a player should carefully repair any ball marks or other damage to the putting green made by the impact of a ball (whether or not made by the player himself). When ball marks are not repaired, they are a significant impediment on the green for several weeks thereafter. Ball marks that are not repaired or repaired improperly can cause putts to track off line and leave unsightly dead brown spots on the green.

Golfers often use a golf tee or other repair tool to raise the depressed portions of the ball mark and flatten the putting surface. Unfortunately, many golfers "fix" the ball mark using the wrong technique, causing additional damage to the green. Golfers often use a repair tool to lift or twist the depressed portion of the ball mark. Although the putting surface may appear smooth and flat, the lifting or twisting action can tear the roots in the grass, creating dead brown spots that take weeks to recover. In fact, studies have shown that it takes longer for the green to recover from a ball mark improperly repaired as opposed to a mark that is left untouched.

Pushing the compressed grass and walls of the ball mark back toward the center of the mark is the preferred method or technique for repairing a ball mark. The golfer should push inward from several positions around the ball mark, rather than from on just one side. Tapping on top of the ball mark with a putter provides a smooth surface for other players.

Unfortunately, prior art repair tools are not well suited for using such a technique. In fact, many prior art repair tools actually promote a lifting or twisting action that can severe the grass roots and damage the root system of the golf green. For example, U.S. Pat. No. 6,565,458 to Cameron discloses a repair tool having prongs angled away from the handle portion of the tool, promoting a lifting action in repairing the ball mark. The device further includes a pivot member that aids in the lifting action. As another example, U.S. Pat. No. D470,556 issued to Guerette et al. discloses a repair tool having flat prongs that are not coplanar with the handle portion. The prongs are angled such that the golfer will tend to push down on the handle after inserting the prongs into the ground, thereby lifting the depressed portion of the ball mark and further damaging the green. Thus, a need exists in the art for an improved ball mark repair tool that facilitates and promotes the proper technique in repairing ball marks.

A general object of the present invention is the provision of an improved ball mark repair tool.

A further object of the present invention is the provision of an improved ball mark repair tool that promotes the proper technique in fixing ball marks.

A still further object of the present invention is the provision of an improved ball mark repair tool that aids in pushing the soil and grass about the periphery of the ball mark toward the center of the mark.

A further object of the present invention is the provision of an improved ball mark repair tool that minimizes the chance of damage to the root system of the grass.

A still further object of the present invention is the provision of an improved method for repairing ball marks on golf greens.

These as well as other objects, features and advantages of the present invention will become apparent from the following specification and claims.

SUMMARY OF THE INVENTION

The foregoing objects are achieved by a golf ball mark repair tool having a body member and a plurality of prongs extending from the body member. The prongs have an arcuate shape and project forwardly from the body member to facilitate pushing soil about the periphery of the ball mark towards the center of the mark. In a preferred form, the prongs of the repair tool have a convexed portion relative to the front surface of the body member. The prongs of the repair tool are shaped so as to encourage and facilitate the proper technique of pushing grass and soil towards the center of the ball mark, not lifting the depressed portion of the mark thereby tearing or otherwise damaging the roots of the grass.

The present invention also includes a new method of repairing a ball mark that speeds recovery time. The method generally includes providing a golf ball mark repair tool as described above, inserting the prongs of the repair tool into the edge of the ball mark, pushing the edge of the ball mark towards its center, and smoothing the surface of the ball mark.

BRIEF DESCRIPTION OF THE DRAWINGS

The present invention is illustrated by way of example and not limitation in the figures of the accompanying drawings, in which like references indicate similar elements and in which.

DETAILED DESCRIPTION OF THE PREFERRED EMBODIMENT

Figure 1:
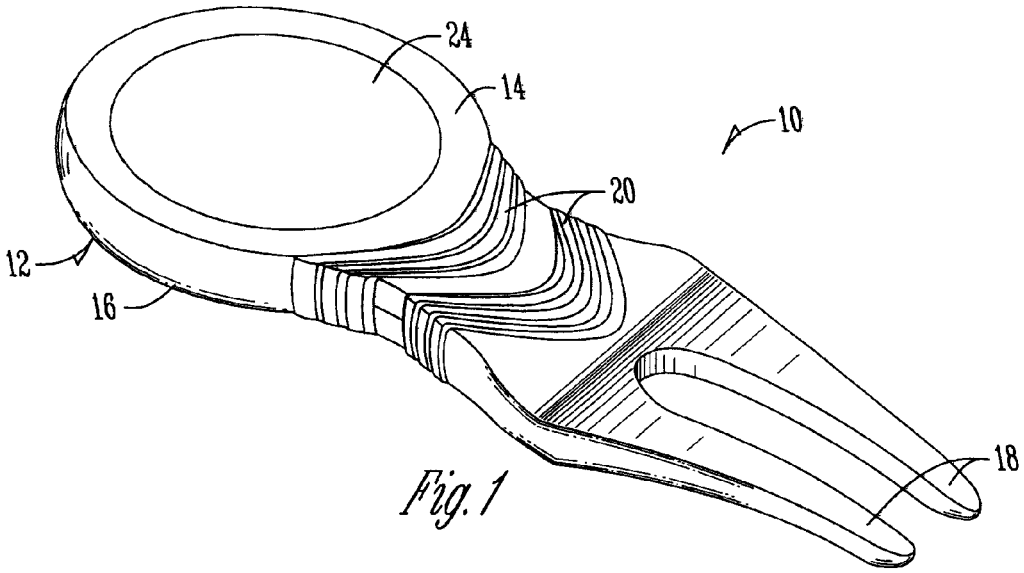
FIG. 1 is a perspective view of a preferred embodiment of the ball mark repair tool of the present invention.

A preferred embodiment of the ball mark repair tool of the present invention is referred to in FIG. 1 generally by the reference numeral 10. The shape and features of the repair tool 10 are shown in FIGS. 1-5. It is seen that the repair tool 10 includes a body member 12 and prongs 18 extending therefrom. The body member 12 includes a generally circular portion that tapers and transitions on one side into the prongs 18. The body member 12 includes a front surface 14 and an opposite back surface 16. The body member 12 and prongs 18 are integrally formed from a cast metal. Those skilled in the art will appreciate that the repair tool 10 could be milled from different metals or made of aluminum.

Figure 2:
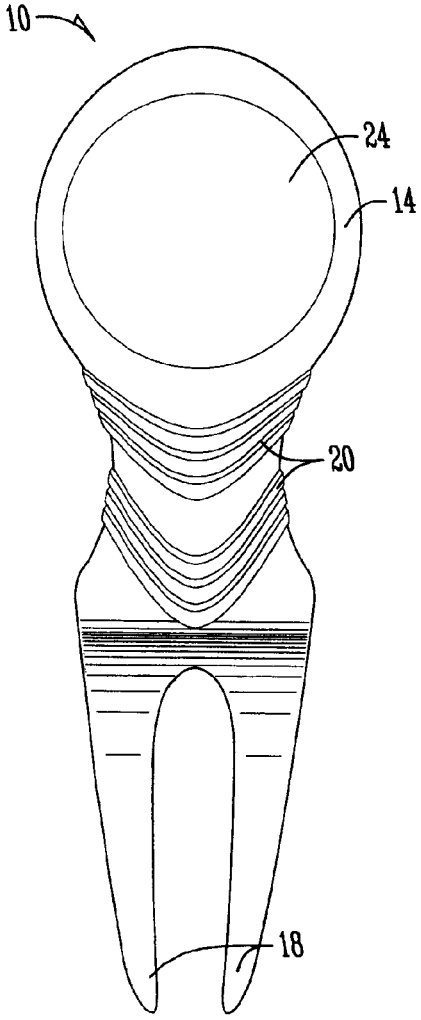
FIG. 2 is a front elevational view of the ball mark repair tool.
Figure 3:
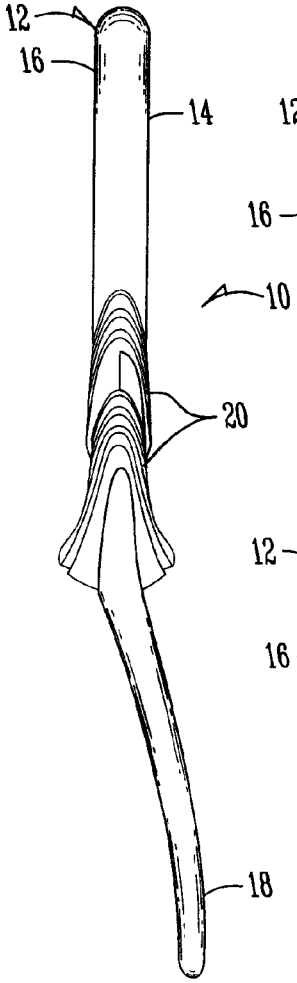
FIG. 3 is a side elevational view of the ball mark repair tool.
Figure 4:
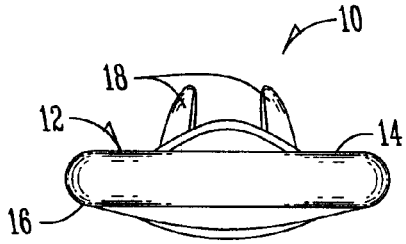
FIG. 4 is a bottom elevational view of the ball mark repair tool.
Figure 5:
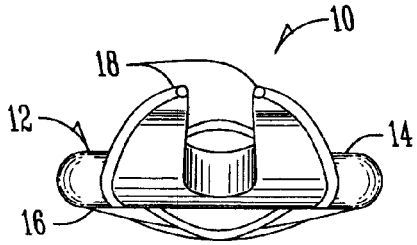
FIG. 5 is a top elevational view of the ball mark repair tool.

The body member 12 provides a handle for the golfer to grip the repair tool 10. A molded rubber portion 20 is adhered to the cast metal as shown in FIGS. 3 and 4. The molded rubber portion 20 provides a gripping surface and helps properly position the user's fingers and thumb on the repair tool 10. As clearly shown in FIG. 3, the molded rubber portion 20 of the body member 12 includes a plurality of raised portions, with at least one raised portion near the prongs 18. In addition, the gripping surface of the rubber portion 20 is contoured, as is shown in FIGS. 1-3.

The body member 12 includes a recessed area 24 for receiving a circular ball marker. The ball marker is made of metal and can be held in place in the recessed area 24 with a high-strength magnet.

As best shown in FIG. 3, the prongs 18 of the repair tool 10 have an arcuate shape and project forwardly from the body member. The prongs are spaced apart and have a convexed shape relative to the front surface 14 of the body member. In a preferred form, the convexed portion has an arc length of approximately 2½ to 3½ cm and an arc angle of approximately 10° to 45°. A repair tool having an arc length of approximately 3 cm and an arc angle of approximately 30° has been found suitable. The width of each prong 18 decreases as the prong 18 extends away from the body member 12.

It is the unique shape of the prongs 18 that help encourage and facilitate the proper technique in fixing ball marks. The arcuate shape of the prong 18 helps encourage the user to push the soil and grass about the edge of the ball mark towards the center of the mark. The convex shape of the prongs 18 also helps to provide mechanical advantage in this respect.

Figure 6:
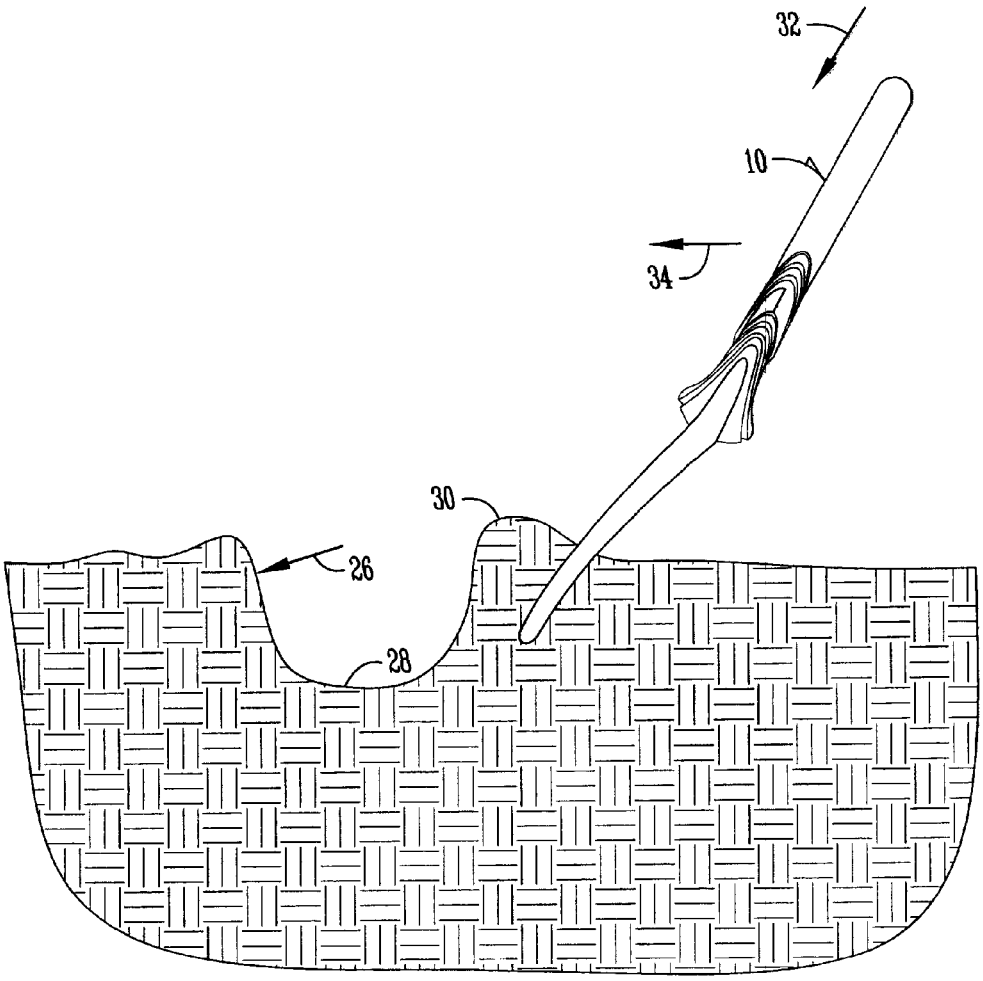
FIG. 6 is a side view of the ball mark repair tool, illustrating the preferred method of repairing ball marks.

The preferred method of using the golf ball repair tool 10 is illustrated in FIG. 6. A ball mark 26 including a depressed or indented portion 28 with a peripheral edge 30 is shown. The prongs 18 of the repair tool 10 are inserted outside the edge or ridge 30 of the ball mark in the direction of arrow 32. The soil is then pushed towards the center of the ball mark as shown by the direction of the arrow 34. This process is repeated at various locations about the periphery of the ball mark 26. The surface of the ball mark 26 is then flattened or smoothed, such as by tapping with the head of a putter.

Those skilled in the art will appreciate that the shape of the prongs 18 relative to the body member 12 improves the ability of the repair tool 10 to move soil about the periphery of the ball mark towards the center of the mark. Those skilled in the art will further appreciate that the shape of the prongs 18 relative to the body member 12 discourages against pulling back on the body member 12, which would cause the prongs to lift soil and possibly tear grass roots adjacent the depressed portion 28 of the ball mark 26.

Using the golf ball repair tool 10 as described herein helps restore the effected area of the golf green to a smooth and flat surface while also minimizing any damage to the root system of the grass. Preventing damage to the root system helps speed the recovery time of the green.

In the preceding detailed description, the invention is described by reference to specific exemplary embodiments thereof. Modifications and changes may be made hereto without departing from the spirit and scope of the invention as set forth in the claims. The specification is, accordingly, to be regarded in an illustrative rather than a restrictive sense. The invention is to be limited only by the claims appended hereto.

What is claimed is:

1. A golf ball mark repair tool that promotes the proper technique for repairing a ball mark on a golf green and which aids in repairing the ball mark while causing minimal damage to the green, the ball mark having edges and a center, the repair tool comprising:

a body member formed of metal and having a length and width generally along a plane and having a front surface and a back surface;

at least two prongs extending from the body member; and a molded rubber portion on the body member;

a gripping surface on the molded rubber portion of the front surface of the body member contoured to position a user's thumb on the repair tool;

wherein each of the prongs has a length and a width, the width of the prong decreasing as the prong extends away from the body member;

wherein each prong generally extends away from the body member forwardly of and above the front surface and in a bowed shape for the length of the prong, relative to the front surface of the body member to facilitate pushing the edges of a ball mark towards the center;

wherein the gripping surface includes at least one raised portion near the prongs to assist in correctly positioning the user's thumb on the repair tool.

2. The golf ball mark repair tool of claim 1 wherein the bowed shape of the prongs has an arc angle of approximately 10° to 45°.

3. The golf ball mark repair tool of claim 1 wherein the prongs are spaced apart.

4. The golf ball mark repair tool of claim 1 wherein the body member includes a generally circular portion.

5. The golf ball mark repair tool of claim 1 further comprising a golf ball marker removably secured to the front surface of the body member above the molded rubber portion.

6. The golf ball mark repair tool of claim 1 wherein a portion of the molded rubber portion is on the back surface of the body member and includes at least one raised portion near the prongs to assist in correctly positioning the user's hand on the repair tool.

7. A golf ball mark repair tool that promotes the proper technique for repairing a ball mark on a golf green and which aids in repairing the ball mark while causing minimal damage to the green, the ball mark having edges and a center, the repair tool comprising:

a body member formed of metal and having a length and width generally along a plane and defining a plane having a front surface and a back surface;

at least two prongs extending from the body member and the plane defined by the body member;

a molded rubber portion on the body member;

a. gripping surface on the front surface of the molded rubber portion, the gripping surface being contoured to position a user's thumb on the repair tool and the gripping surface including a plurality of raised portions;

wherein each of the prongs has a length and a width, the width of the prong decreasing as the prong extends away from the body member;

wherein each prong extends away from the body member and the plane in a direction forwardly and above of the front surface and in a bowed shape relative to the front surface of the body member and for the length of the prong to facilitate pushing the edges of the ball mark towards the center and the front surface of the body member, the molded rubber portion including at least one raised portion near the prongs to assist in correctly positioning a user's thumb on the repair tool.

8. A golf ball mark repair tool that promotes the proper technique for repairing a ball mark on a golf green and which aids in repairing the ball mark while causing minimal damage to the green, the ball mark having edges and a center, the repair tool comprising:

a body member having a front surface and a back surface and a first axis therethrough;

at least two prongs extending from the body member;

wherein each of the prongs generally extends along a second axis that is obtuse to the first axis, wherein each prong further comprises a bowed shape having a convex side and a concave side, the concave sides facing toward the first axis and the convex side facing away from the first axis;

a portion on the body member; and a gripping surface on the portion of the front surface of the body member and being contoured with at least one raised portion near the prongs to assist in correctly positioning the user's thumb on the front surface of the repair tool.

* * * * *